US007768190B2

(12) United States Patent
Jun

(10) Patent No.: US 7,768,190 B2
(45) Date of Patent: Aug. 3, 2010

(54) ELECTRON EMISSION DISPLAY

(75) Inventor: Pil-Goo Jun, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 408 days.

(21) Appl. No.: 11/689,021

(22) Filed: Mar. 21, 2007

(65) Prior Publication Data

US 2007/0284997 A1 Dec. 13, 2007

(30) Foreign Application Priority Data

Apr. 20, 2006 (KR) ..... 10-2006-0035819

(51) Int. Cl.
*H01J 1/62* (2006.01)

(52) U.S. Cl. ..... 313/495

(58) Field of Classification Search ..... 313/495, 313/496–497, 306, 308–310
See application file for complete search history.

(56) References Cited

U.S. PATENT DOCUMENTS

| | | | | |
|---|---|---|---|---|
| 5,637,951 | A * | 6/1997 | Parker | 313/336 |
| 6,046,541 | A * | 4/2000 | Valliath et al. | 313/495 |
| 6,429,599 | B1 * | 8/2002 | Yokoyama | 315/169.3 |
| 2005/0057178 | A1 * | 3/2005 | Yaguchi et al. | 315/169.4 |
| 2005/0189865 | A1 * | 9/2005 | Lee | 313/495 |

* cited by examiner

*Primary Examiner*—Nimeshkumar D Patel
*Assistant Examiner*—Peter R Haderlein
(74) *Attorney, Agent, or Firm*—Stein McEwen, LLP

(57) ABSTRACT

An electron emission display includes first and second substrates facing each other and having a long-axis and a short-axis, first electrodes arranged on the first substrates, second electrodes arranged to intersect the first electrodes while maintaining electrical insulation from the first electrodes, electron emission regions electrically connected to one of the first and second electrodes, and phosphor layers formed on a surface of the second substrate. Intersected regions of the first and second electrodes are disposed at a predetermined angle to either the long-axis or the short-axis.

20 Claims, 10 Drawing Sheets

ELECTRON EMISSION DISPLAY

CROSS-REFERENCE TO RELATED APPLICATIONS

This application claims the benefit of Korean Application No. 2006-35819, filed Apr. 20, 2006, in the Korean Intellectual Property Office, the disclosure of which is incorporated herein by reference.

BACKGROUND OF THE INVENTION

1. Field of the Invention

Aspects of the present invention relates to an electron emission display, and more particularly, to an electron emission display having an improved arrangement and structure of the sub-pixels.

2. Description of the Related Art

Generally, electron emission elements are classified into those using hot cathodes as an electron emission source, and those using cold cathodes as the electron emission source.

There are several types of well known electron emission elements using the cold cathode, a field emission array (FEA) type, a surface conduction emission (SCE) type, a metal-insulator-metal (MIM) type, and a metal-insulator-semiconductor (MIS) type.

The FEA type electron emission element includes an electron emission region, and cathode and gate electrodes functioning as driving electrodes for controlling the electron emission of the electron emission region. The electron emission regions are formed of a material having a relatively lower work function or a relatively large aspect ratio, e.g., a carbon-based material such as carbon nanotubes, graphite, and diamond-like carbon, so as to effectively emit electrons when an electric field is formed around the electron emission regions under a vacuum atmosphere.

The electron emission elements are arrayed on a first substrate to constitute an electron emission unit. The electron emission unit is combined with a light emission unit having phosphor layers, black layers, and an anode electrode which are formed on a surface of a second substrate facing the first substrate, to constitute an electron emission display.

In a conventional FEA type electron emission display, on the first substrate, cathode and gate electrodes are formed in a linear parallel pattern extending in directions to intersect each other at right angles with an insulation layer disposed between them, and electron emission regions are formed at each intersected region of the cathode and gate electrodes. Further, on a surface of the second substrate, one of the red, green, and blue phosphor layers is disposed in response to the respective intersected region of the gate and cathode electrodes.

Each of the intersected regions of the cathode and gate electrodes corresponding to one of the phosphor layers constitutes a sub-pixel, and three sub-pixels including the red, green, and blue phosphor layers constitutes a pixel. In current practice, each of the sub-pixels is rectangular-shaped, and rows of sub-pixels are arranged to extend in the long-axis and short-axis directions of the first substrate.

However, in the structure just described above, an electron beam spread occurs at each of the sub-pixels while the display is being operated, and electrons emitted from a particular sub-pixel may reach a phosphor layer of an adjacent sub-pixel that has a different color, thereby emitting a light of a different color.

In particular, the center region of an electron beam spot reaching the respective phosphor layers is convexly oval-shaped along the long-axis direction (typically the horizontal direction of the display), and the phosphor layers in the structure of the sub-pixels described above are disposed close to each other in the long-axis direction of the first substrate in order to realize high resolution, thereby easily causing emission of light of a different color. This emission of light in a different color reduces color purity, thereby deteriorating display quality.

Meanwhile, in order to solve the problems described above, there have been attempts to minimize the electron beam spread by lowering the driving voltage. However, in this case, the flow of electrons is reduced, thereby lessening the luminance.

SUMMARY OF THE INVENTION

Aspects of the present invention provide an electron emission display preventing an electron beam spot for a particular sub-pixel from emitting the light of a phosphor layer having a different color, even when an increased driving voltage enlarges the electron beam spot, thereby heightening screen luminance and color purity and having advantages for producing images of high resolution.

According to one embodiment of the present invention, an electron emission display includes: a) first and second substrates facing each other whose long-axis and short-axis are set, b) first electrodes formed on the first substrate, c) second electrodes formed to intersect the first electrodes and maintain electrical insulation from the first electrodes, d) electron emission regions electrically connected to either the first or the second electrodes, e) phosphor layers formed on a surface of the second substrate, and f) an anode electrode disposed on a surface of the phosphor layers. Intersected regions of the first and second electrodes are disposed at an angle to the long-axis or short-axis.

The intersected regions may be oriented at an angle to the long-axis direction of the first substrate with either an acute or an obtuse angle.

Three intersected regions form a set extending in the long-axis direction of the first substrate, which may have the same angle to the long-axis of the first substrate.

The set of the intersected regions may be oriented at an angle to the long-axis direction of the first substrate with either an acute or an obtuse angle. Further, a neighboring set in the long-axis and/or short-axis directions of the first substrate may be oriented with a different angle. Furthermore, the phosphor layers that is, the red, green, and blue phosphor layers, are disposed opposite the respective intersected regions, which may be disposed at the intersected regions of the set.

Meanwhile, the intersected region is oriented at an angle to the long-axis of the first substrate which is either an acute or an obtuse angle. Further, a neighboring intersected region of the intersected region in the long-axis and/or short-axis directions of the first substrate may be oriented with an angle that is the opposite, that is, obtuse or acute, respectively.

In another embodiment, intersected regions may include first and second intersected regions neighboring each other in the long-axis direction of the first substrate, and third and fourth intersected regions disposed next to the first and second intersected regions in the short-axis direction of the first substrate. The first and the fourth crossed regions are oriented at an angle to the long-axis direction of the first substrate that is either acute or obtuse, and the second and the third intersected regions are oriented at an angle to the long-axis direction of the first substrate that is the other angle, that is, obtuse or acute angles, respectively.

Sets formed from the first through fourth intersected regions may be disposed in parallel extending in the short-axis direction of the first substrate.

In a third embodiment, the sets formed from the first through fourth intersected regions may be alternately disposed in a zigzag pattern. In this embodiment, the intersected regions include the fifth and sixth intersected regions disposed next to the first and second intersected regions in the long-axis direction of the first substrate; and the seventh and eighth intersected regions disposed next to the fifth and sixth intersected regions in the short-axis direction of the first substrate, while the sixth and the seventh intersected regions are oriented at an angle to the long-axis direction of the first substrate that is the same angle as that of the first intersected region, and the fifth and the eighth intersected regions are oriented at an angle to the long-axis direction of the first substrate that is the same angle as that of the second intersected region.

In a configuration where the first through fourth intersected regions form a set, the phosphor layers include red, green, and blue phosphor layers, and the red, green, and blue phosphor layers are disposed respectively opposite the three intersected regions of the set. Further, one of the red, green, and blue phosphor layers may be additionally disposed in the remaining intersected region of the set.

In the description above, the acute and obtuse angles satisfy the condition:

$$\theta 1+\theta 2=180^\circ$$

where $\theta$1 is the acute angle and $\theta$2 is the obtuse angle.

Meanwhile, one of the first and second electrodes includes a screen region that forms an intersected region where one of the first and second electrodes intersects the other one, as well as a connection region connected to the screen region, where the screen and the connection regions may be oriented with a predetermined angle to each other.

The electron emission regions may be disposed in a row at the intersected regions extending in the lengthwise direction of the intersected region.

In a fourth embodiment of the invention, the electron emission display may further include a focusing electrode disposed at an upper part of the first and second electrodes and maintaining electrical insulation between the first and second electrodes.

As described above, the electron emission display has regions oriented at an angle to each other where the first and second electrodes cross each other. Therefore, since the widest region of the electron beam spot is not on the same line but disposed alternately, even when an increased driving voltage enlarges the size of the electron beam spot, the electron emission display of this embodiment avoids the situation where the electron beam spot of a particular sub-pixel causes the emission of light from a different phosphor layer in an adjacent sub-pixel, thereby simultaneously improving screen luminance and color purity.

Also, the distance between the first electrodes may be shortened, thereby having the advantage of producing a higher resolution electron emission display.

Further, according to an embodiment of the present invention, the display device has an expanded black layer, thereby substantially widening the spacer-locating region.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
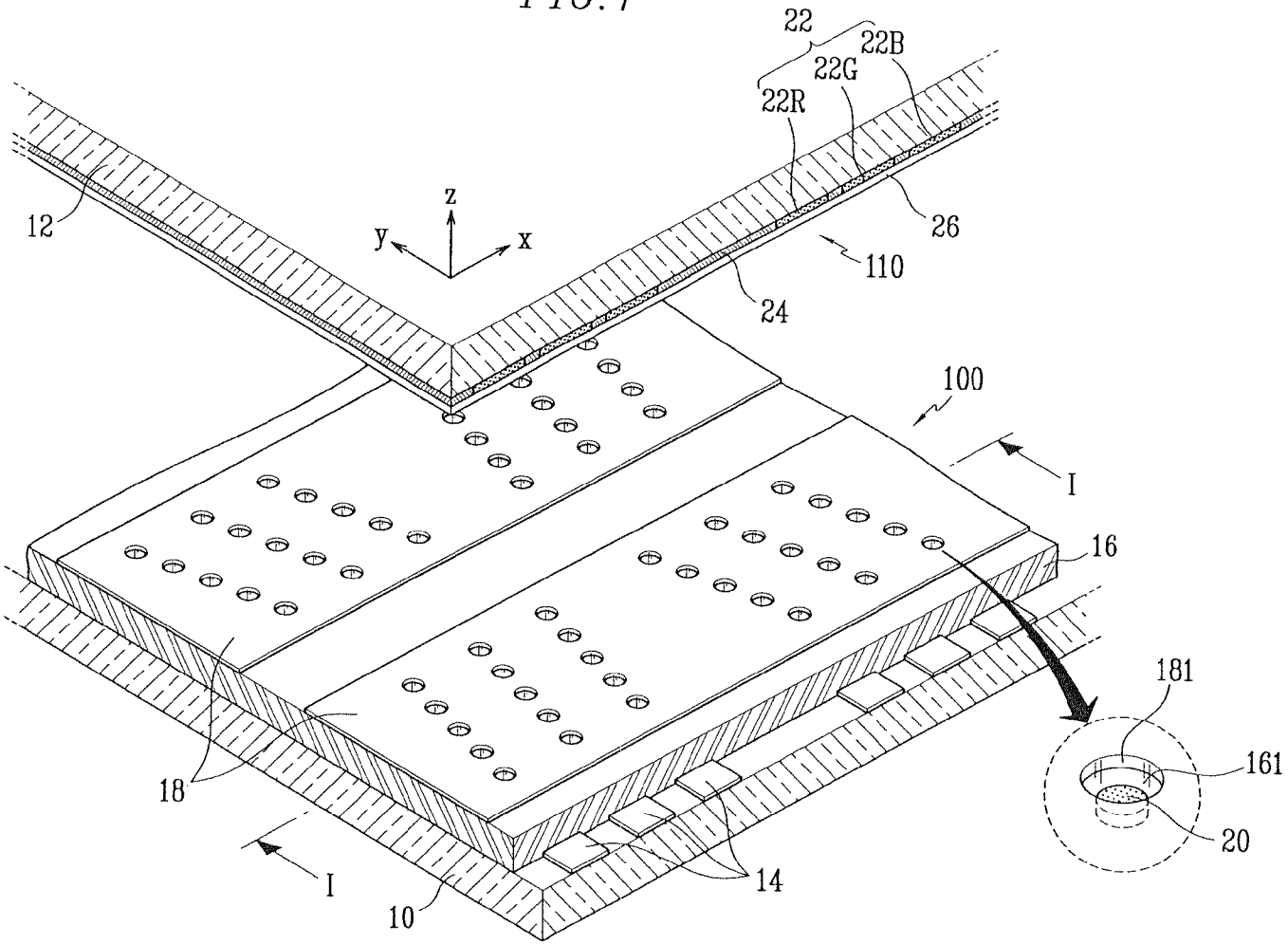
FIG. 1 is a partially exploded perspective view of an electron emission display according to a first embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
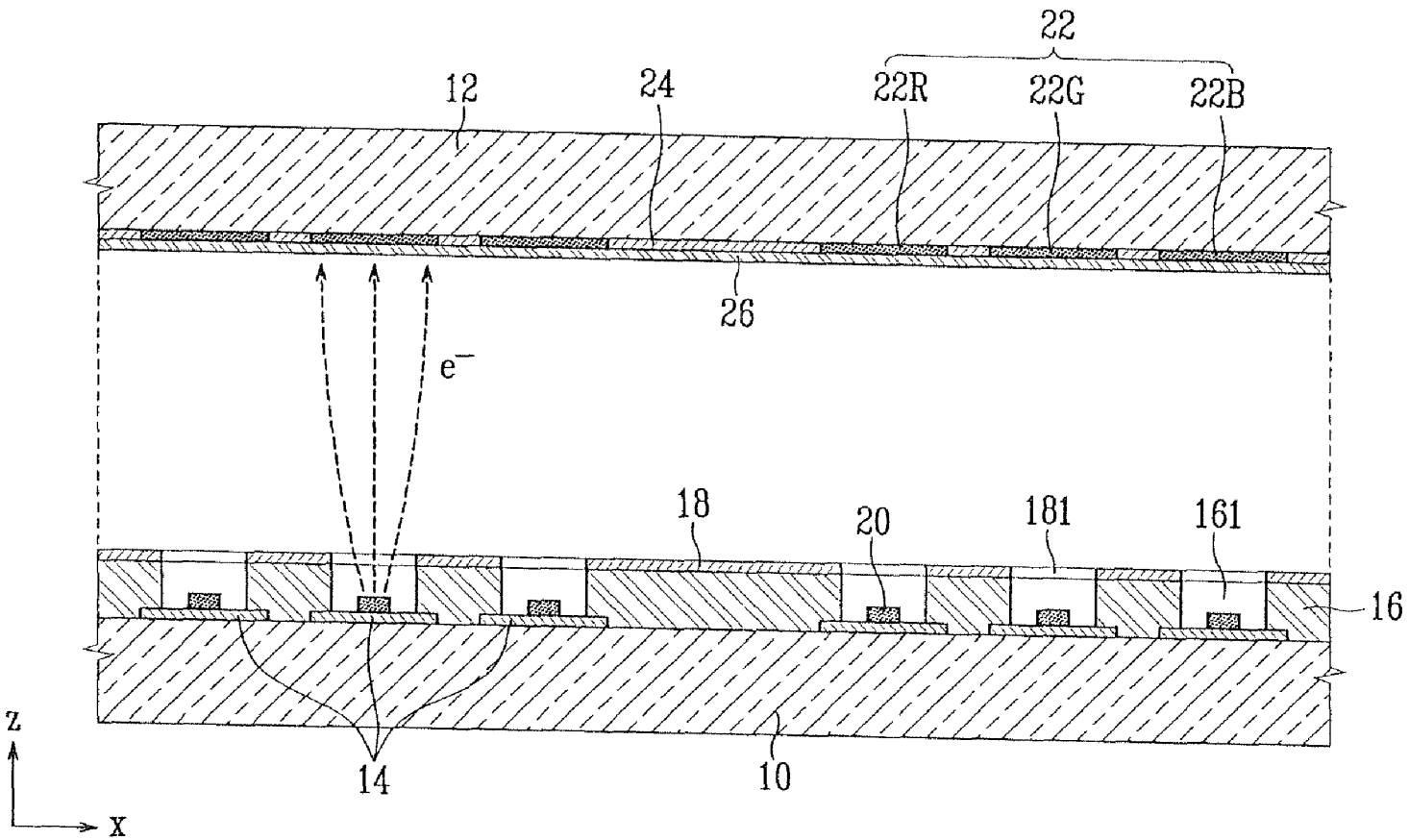
FIG. 2 is a partial sectional view of an electron emission display according to the first embodiment of the present invention taken along line I-I of FIG. 1.

FIGS. 1 and 2 are, respectively, a partial exploded perspective view and a partial sectional view of an electron emission display according to a first embodiment of the present invention.

Referring to FIGS. 1 and 2, the electron emission display includes first and second substrates 10 and 12 facing each other and spaced apart from each other at a predetermined distance. A sealing member (not shown) is disposed around the perimeters of the first and second substrates 10 and 12 to seal them together, and the inner space enclosed by the first and second substrates 10 and 12 and the sealing member is evacuated to a predetermined degree of vacuum. Therefore, the first and second substrate 10 and 12 and the sealing member form a vacuum envelope.

On the first substrate 10, an electron emission unit 100 including an array of electron emission elements is provided at the surface facing the second substrate 12. Further, on the second substrate 12, a light emission unit 110 is provided at the surface facing the first substrate 10. The electron emission unit 100 and the light emission unit 110 constitute the electron emission display.

First, on the first substrate 10, the first electrodes, which are cathode electrodes 14, are formed extending in one direction, and insulation layers 16 are formed on the first substrate 10 to cover the cathode electrodes 14. The second electrodes, which are gate electrodes 18, are formed on the insulation layers 16 in a linear parallel pattern extending in another direction.

The first and second substrates 10 and 12 may be formed in a rectangular shape having long-axis and short-axis directions. When it is specified, for convenience, that the x-axis directions of the figures are the long-axis directions of the substrates and the y-axis directions of figures are the short-axis directions, the cathode electrodes 14 are formed extending in the short-axis direction of the first substrate 10 and the gate electrodes 18 are formed extending in the long-axis direction of the first substrate 10.

Figure 3:
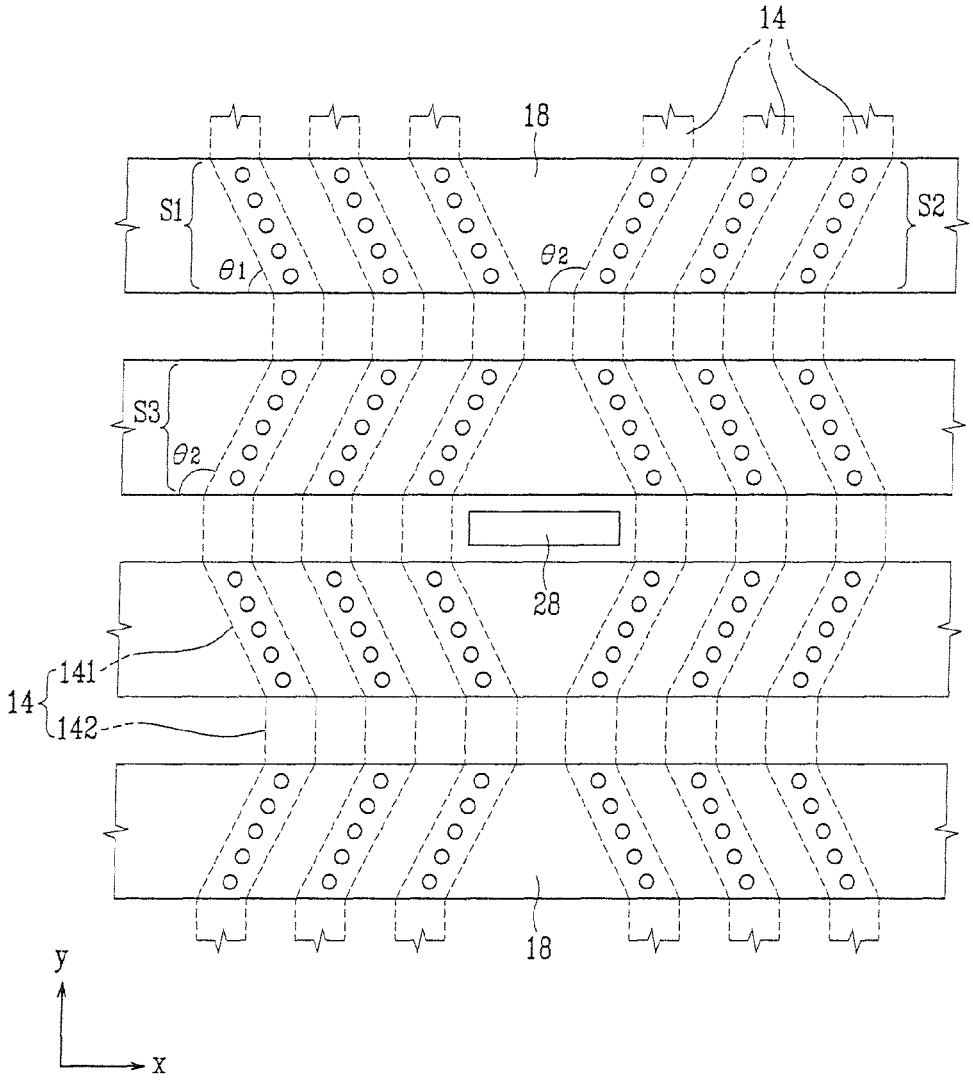
FIG. 3 is a partial top view of an electron emission unit of an electron emission display according to the first embodiment of the present invention.

As shown in more detail in FIG. 3, the cathode electrodes 14 of this embodiment include screen regions 141 (see FIG. 3) forming intersected regions with the gate electrodes 18 and connection regions 142 disposed between the screen regions 141 and connecting the screen regions 141. Each screen region 141 of the cathode electrodes 14, that is an intersected region of the two electrodes, is opposite a sub-pixel region, and the electron emission regions 20 are formed on the respective screen regions 141.

Returning to FIG. 1, openings 161 and 181 that are respectively formed on the insulation layers 16 and the gate electrodes 18 are formed on the first substrate 10 to expose the electron emission regions 20. The electron emission regions 20 may be formed in a row extending in the lengthwise direction of the screen region 141. Further, each of the electron emission regions 20 and the gate electrode openings 181 may be formed in a circular-shape.

The electron emission regions 20 are formed of a material that emits electrons when an electric field is applied thereto under a vacuum, such as carbon nanotubes, graphite, graphite nanofibers, diamonds, diamond-like carbon, $C_{60}$, silicon nanowires, or a combination thereof. The manufacturing processes that may be applied are screen-printing, direct growth, chemical vapor deposit, or sputtering.

In the alternative, the respective electron emission regions 20 each may be in the form of a molybdenum-based or silicon-based tip structure having a pointed end.

Again as shown in more detail in FIG. 3, the cathode electrodes 14 of this embodiment have the screen regions 141 and the connection regions 142 at an angle to each other, with a predetermined angle. More particularly, the connection regions 142 are disposed in parallel in the short-axis directions of the two substrates 10 and 12, and the screen regions 141 are angled from the connection regions 142 with a predetermined angle, where the intersected regions of the cathode electrodes 141 and the gate electrodes 18 have either an acute or an obtuse angle along the long-axis direction of the two substrates 10 and 12.

As disclosed briefly above, the screen regions 141 of the cathode electrodes 14 form a set S1 with each of the three screen regions 141 in the long-axis (X-axis) direction of the two substrates 10 and 12, and are oriented with the same angle to the long-axis directions of the first substrate 10. The intersected regions in the set S1, which are opposite specific red, green, and blue phosphor layers described below, constitute a pixel.

Further, when the intersected region of the set S1 is oriented with an acute angle θ1 extending in the long-axis (X-axis) direction of the two substrates 10 and 12, the intersected region of the neighboring set S2 to the set S1 along the long-axis (X-axis) direction of the two substrates 10 and 12 and the intersected region of the neighboring set S3 of the set S1 along the short-axis (Y-axis) direction of the two substrates 10 and 12 are oriented with an obtuse angle θ2 extending in the long-axis (X-axis) directions of the two substrate 10 and 12. Furthermore, the sum of θ1 and θ2 along both axes is 180°.

Next, referring back to FIGS. 1 and 2, on the surface of the second substrate 12 facing toward the first substrate 10, for example, red, green, and blue phosphor layers 22R, 22G, and 22B (collectively 22) are disposed apart from each other at predetermined distances, and a black layer 24 is formed in the same plane between the phosphor layer groups 22 in order to improve the screen contrast. One of the phosphor layers 22R, 22G, and 22B (collectively 22) is disposed opposite each intersected region of the cathodes and gate electrodes 14 and 18.

An anode electrode 26 formed of a metal film such as aluminum is formed on the phosphor layers 22 and the black layer 24. The anode electrode 26 receives the high voltage required for accelerating the electron beams, keeps the phosphor layers 22 at high electric potential, and also functions to enhance the screen luminance by reflecting visible light. That is, among the visible light emitted from the phosphor layers 22, the visible light that is emitted from the phosphor layers 22 toward the first substrate 10 is reflected by the anode electrode 26 toward the second substrate 12.

Meanwhile, the anode electrode may also be a transparent conductive film formed of, for example, indium tin oxide (ITO). In this case, the anode electrode is formed on surfaces of the phosphor layers 22 and the black layer 24 that face the second substrate 12. Also, it is possible for the anode electrode to be formed of the transparent conductive film and the metal film simultaneously.

Figure 4:
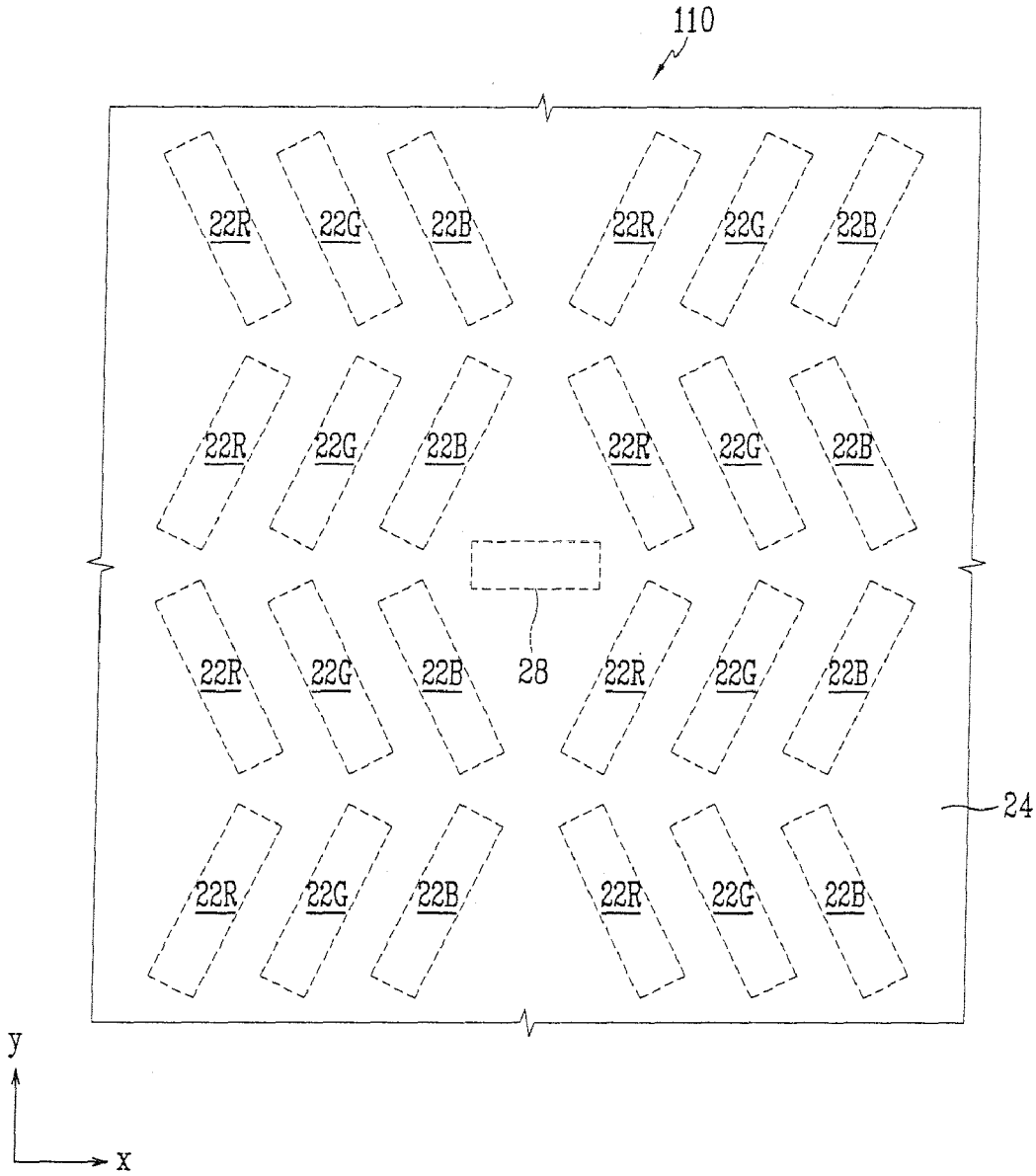
FIG. 4 is a partial top view of a light emission unit of an electron emission display according to the first embodiment of the present invention.

FIG. 4 is a partial top view of the light emission unit, where the phosphor layers 22R, 22G, and 22B each are disposed at an angle opposite the shape of the intersected region of the cathode and gate electrodes 14 and 18 with the same angle from the long-axis (X-axis) directions of the two substrates to the corresponding intersected region. Particularly, when the three intersected regions form a set, one of the phosphor layers 22R, 22G, and 22B is disposed opposite each intersected region such that the three intersected regions and the three phosphor layers form a pixel (also see FIG. 2 for an illustration of this).

Spacers 28 are disposed between the first and the second substrates 10 and 12 to support the vacuum envelope under the pressure applied thereto and maintain a uniform gap between the first and the second substrates 10 and 12. The spacers 28 are located opposite the black layer 24 such that the spacers 28 do not cover the area of the phosphor layers 22.

The spacer 28 of this embodiment may be a rectangular column having a predetermined length, width, and height. The spacer 28 may be disposed at a position where the distance between the cathode electrodes 14 on the insulation layer 16 disposed between the gate electrodes 18 becomes the longest. An example of a mounting position of the spacer 28 is shown in FIG. 3.

In the configuration described above (FIGS. 1-4), the electron emission display is driven by supplying a predetermined external voltage to the cathode, gate, and anode electrodes 14, 18, and 26. For example, one of the cathode and gate electrodes 14 and 18 receives a scan driving voltage to function as a scan electrode while the other receives a data driving voltage to function as a data electrode. The anode electrode 26 receives a positive direct current voltage of anywhere from hundreds to thousands of volts, which is required for accelerating an electron beam.

Then, electric fields are formed around the electron emission regions 20 due to the voltage difference between the cathode electrode 14 and the gate electrode 18, and electrons are emitted from the electron emission regions 20. The emitted electrons are attracted by the high voltage supplied to the anode electrode 26, thereby colliding against the phosphor layers 22 at the relevant sub-pixels and causing them to emit light.

Figure 5:
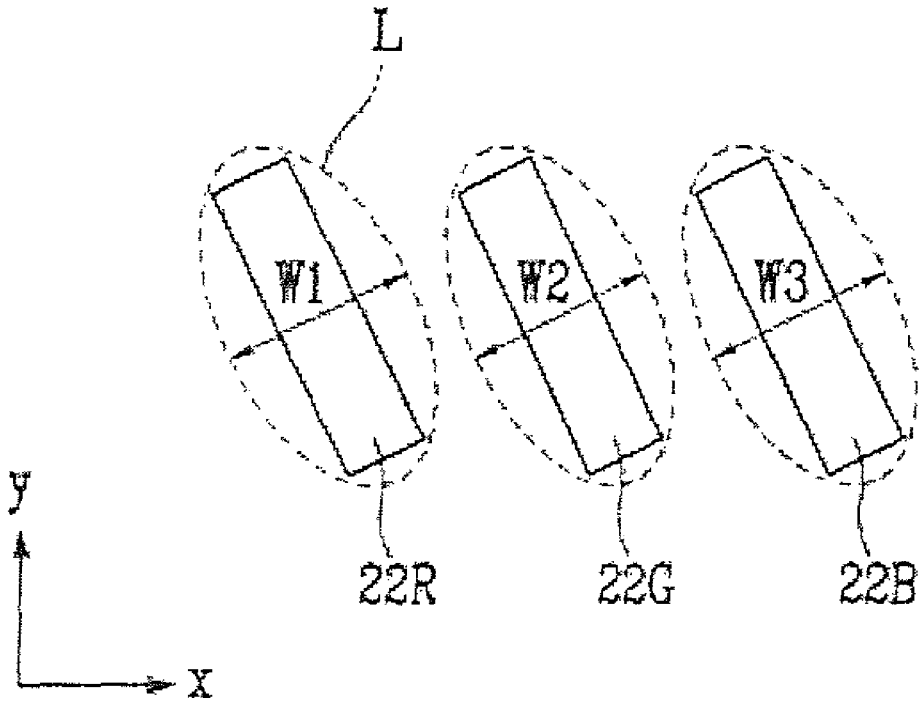
FIG. 5 is a schematic top view of phosphor layers and an electron beam spot reaching respective phosphor layers in an electron emission display according to the first embodiment of the present invention.

FIG. 5 is a schematic view of the phosphor layers 22R, 22G, and 22B that constitute a pixel, and electron beam spots reached at the respective phosphor layers 22R, 22G, and 22B.

Referring to FIG. 5, the electron beam spot L basically maintains the shape of the intersected region, which has a convexly oval-shaped center portion due to electron beam spread. Therefore, each of the electron beam spots L has the maximum width W1, W2, or W3 crossing the lengthwise direction of the intersected region at a right angle. In the configuration of the intersected regions and the phosphor layers 22R, 22G, and 22B of the embodiment described above, regions of the electron beam spots L having the maximum widths W1, W2, and W3 are not on the same line but offset from each other.

Therefore, even when an increased driving voltage enlarges the size of the electron beam spot L, the regions having the maximum widths are offset from each other and do not interfere with each other, thereby effectively eliminating the possibility of an electron beam spot aimed at one sub-pixel from contacting and therefore emitting the light of the phosphor layer in a neighboring sub-pixel.

Further, in this embodiment, compared to a conventional light emission unit, the actual area of the black layer 24 on the second substrate 12 can be increased as well. Such an increased area of the black layer 24 enables a dark screen to appear darker and a bright screen to be brighter upon the application of a higher driving voltage.

Figure 6:
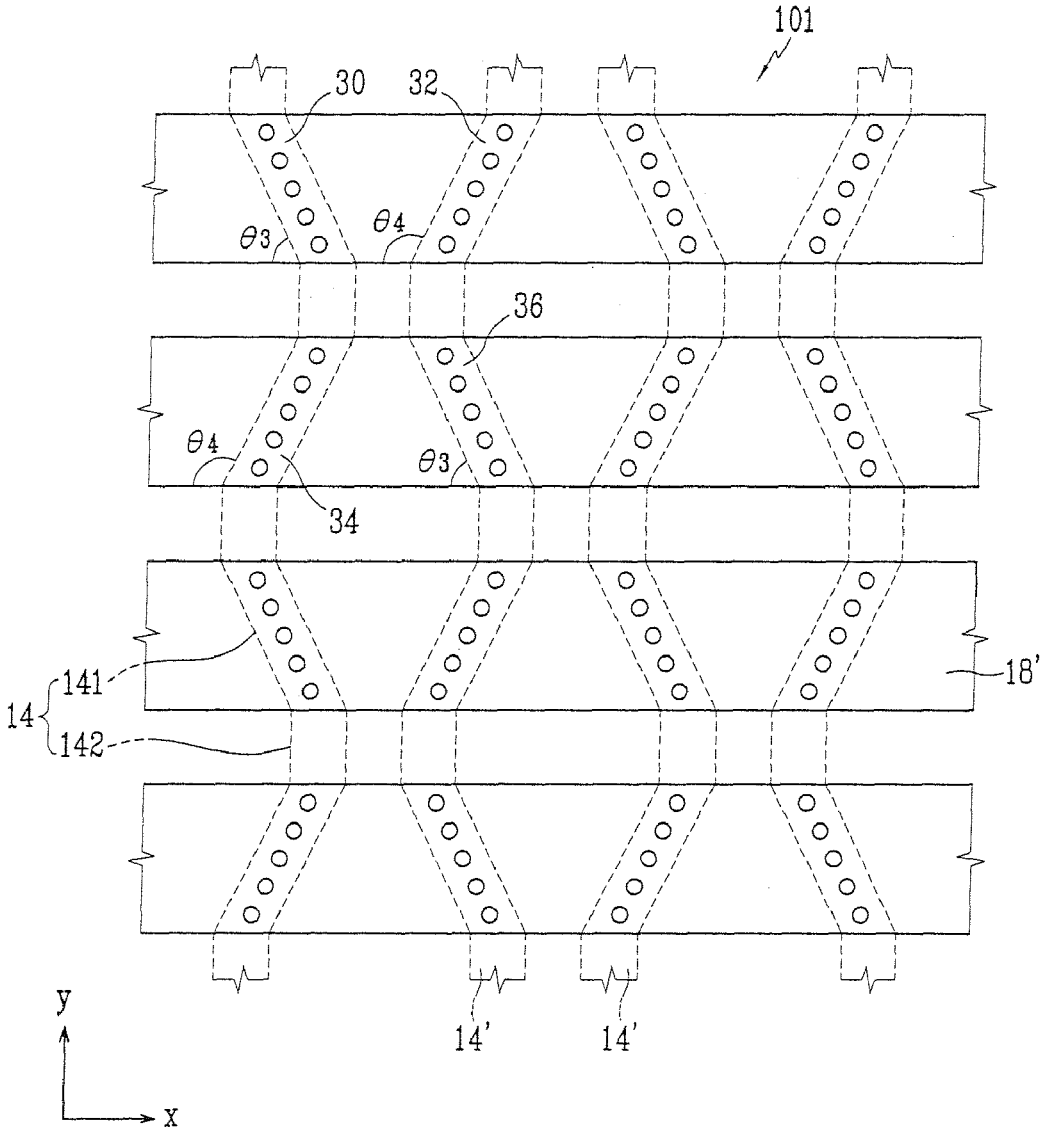
FIG. 6 is a partial top view of an electron emission unit of an electron emission display according to a second embodiment of the present invention.
Figure 7:
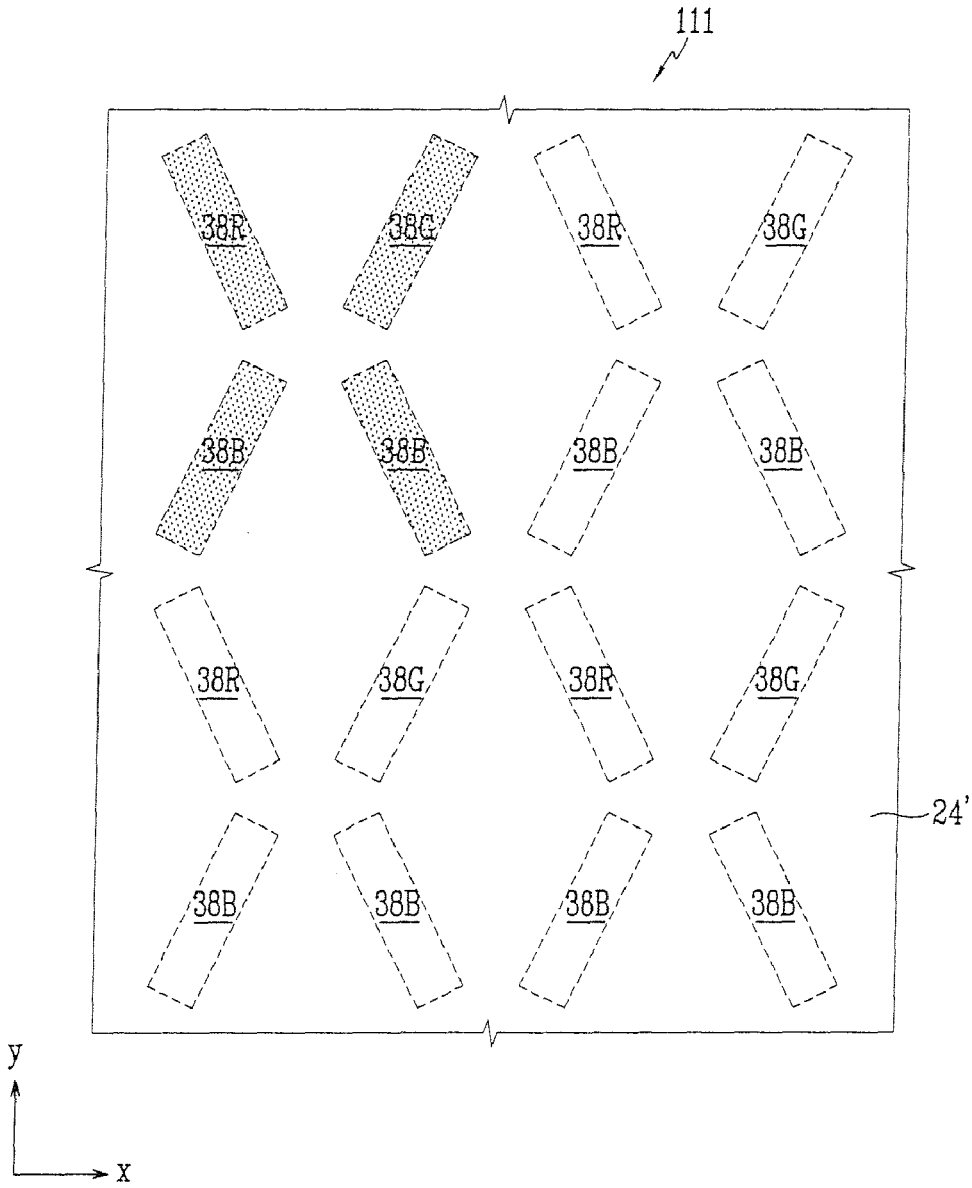
FIG. 7 is a partial top view of a light emission unit of an electron emission display according to the second embodiment of the present invention.

FIGS. 6 and 7 are, respectively, partial top views of an electron emission unit 101 and a light emission unit 111 according to a second embodiment of the present invention.

Referring to FIG. 6, when an intersected region 30 is disposed in the long-axis (X-axis) direction with an acute angle θ3, adjacent intersected regions of the intersected region 30 extending in the long-axis (X-axis) direction and adjacent intersected regions of the intersected region 30 extending in the short-axis (Y-axis) direction are disposed at an angle with the obtuse angle θ4. Furthermore, as above with θ1 and θ2, the sum of θ3 and θ4 along both axes is 180°.

Particularly, the two intersected regions of this embodiment, which are adjacent along the long-axis (X-axis), can be defined as first and second intersected regions 30 and 32, and the two intersected regions of this embodiment, which are adjacent along the short-axis (Y-axis), can be defined as third and fourth intersected regions 34 and 36. Then, the first and fourth intersected regions 30 and 36 are disposed at the acute angle θ3, and the second and third intersected regions 32 and 34 are disposed at the acute angle θ4.

These four intersected regions 30, 32, 34, and 36 form a set disposed in parallel extending in the long-axis (X-axis) and short-axis (Y-axis) directions. Again, the sum of θ3 and θ4 along both axes is 180°.

Referring to FIG. 7, each of phosphor layers 38R, 38G, and 38B is disposed at an angle consistent with the orientation of an intersected region of the cathode and gate electrodes 14' and 18' with the same angle from the long-axis directions of the two substrates to the corresponding intersected region.

In this embodiment, one of the phosphor layers 38R, 38G, and 38B, for example, the red phosphor layer 38R, is disposed opposite one of the four intersected regions 30, 32, 34, 36, for example 30, another of the phosphor layers, for example, the green phosphor layer 38G is disposed opposite one of the four intersected regions 30, 32, 34, 36, for example 32, and the others of the phosphor layers, for example, the blue phosphor layer 38B are disposed opposite the others of the four intersected regions 30, 32, 34, 36, for example 34 and 36.

Therefore, the four intersected regions of the embodiment 30, 32, 34, and 36 and the corresponding four phosphor layers 38R, 38G, 38B, and 38B constitute a pixel. Furthermore, one of the phosphor layers 38R, 38G, and 38B, for example 38B, having the lowest light emission efficiency may be disposed in a pair in the pixel, thereby increasing the overall light emission efficiency of the phosphor layers. In FIG. 7, the four phosphor layers constituting a pixel are shaded darker.

Further (not illustrated, but analogous to FIG. 5), each of the electron beam spots L that are reached at the phosphor layers 38R, 38G, and 38B has the maximum width crossing in a lengthwise direction of the intersected region at right angles. Regions of the electron beam spots L having the maximum widths W1, W2, or W3 are not on the same line but offset from each other, thereby effectively eliminating light emission of a different color.

Figure 8:
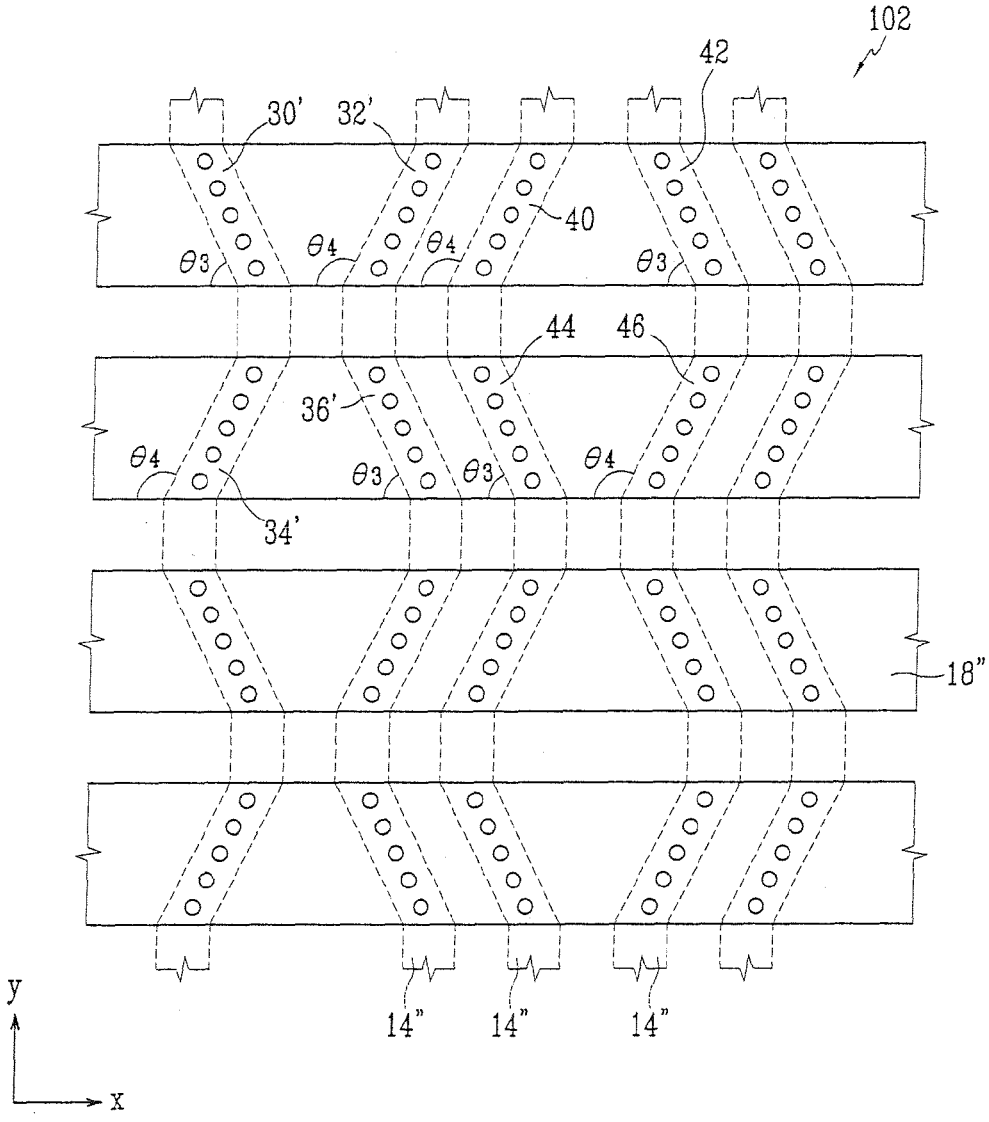
FIG. 8 is a partial top view of an electron emission unit of an electron emission display according to a third embodiment of the present invention.
Figure 9:
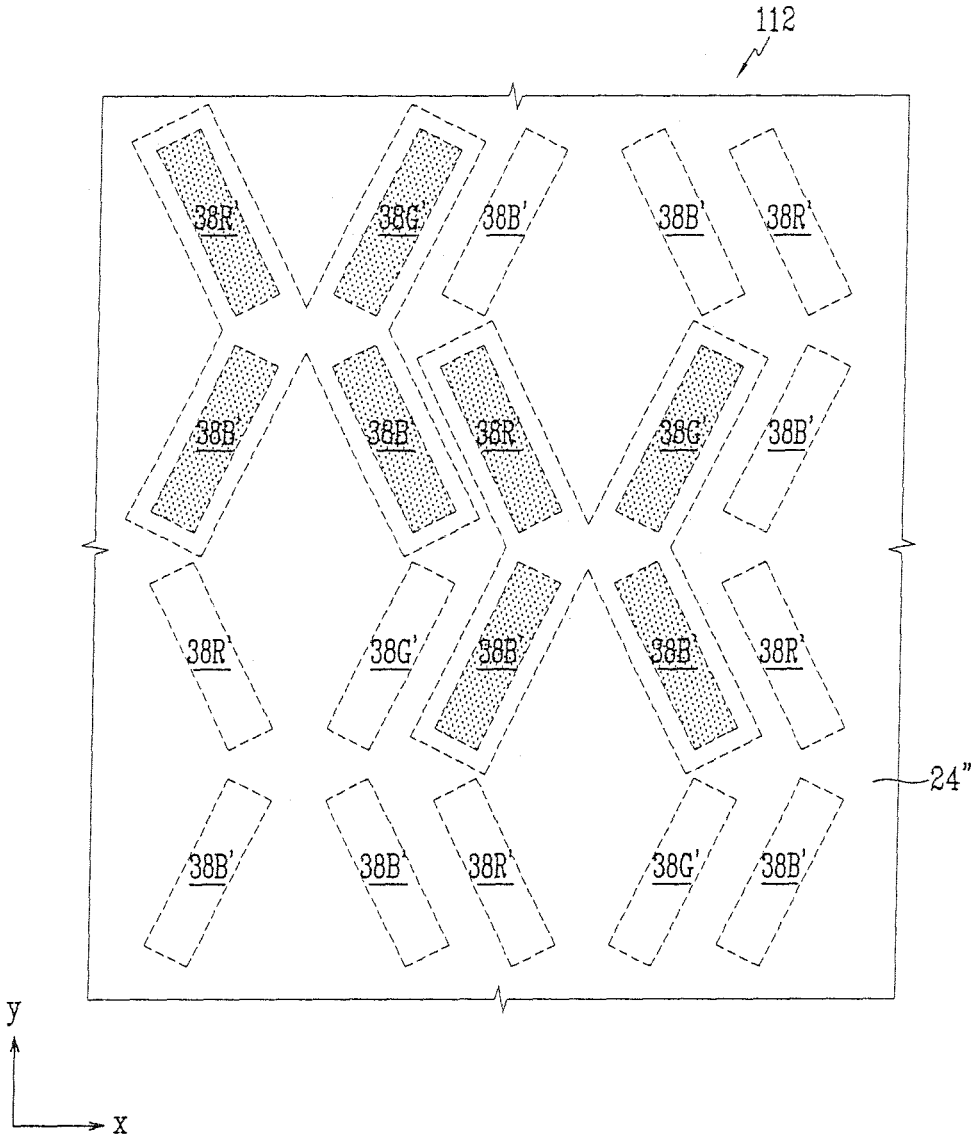
FIG. 9 is a partial top view of a light emission unit of an electron emission display according to the third embodiment of the present invention.

FIGS. 8 and 9 are respectively partial top views of an electron emission unit 102 and a light emission unit 112 of an electron emission display of a third embodiment of the present invention.

Referring to FIGS. 8 and 9, analogous to the second embodiment described above, a configuration is provided that four intersected regions of the embodiment 30', 32', 34', and 36', which constitute a pixel, are disposed alternately in a zigzag pattern extending in the short-axis (Y-axis) directions of the two substrates.

However, in this embodiment, the two intersected regions of the embodiment, which are disposed next to the first and second intersected regions 30' and 32' in the long-axis (X-axis) of the two substrate, are set as fifth and sixth intersected regions 40 and 42, and the two intersected regions of the embodiment, which are disposed next to the fifth and sixth intersected regions 40 and 42 in the short-axis (Y-axis) of the two substrates, are set as seventh and eighth intersected regions 44 and 46. Then, the sixth and seventh intersected regions 42 and 44 are disposed with the same angle θ3 as that of the first intersected region 30' in the long-axis (X-axis) direction, and the fifth and eighth intersected regions 40 and 46 are disposed with the same angle θ4 as that of the second intersected region 32' in the long-axis (X-axis) direction.

Further, each of the phosphor layers 38R', 38G', and 38B' is disposed at an angle in response to the orientation of the intersected region of the cathode and gate electrodes 14" and 18" opposite to the phosphor layers, with the same angle in the long-axis (X-axis) directions of the two substrates to the corresponding intersected region. In FIG. 9, four phosphor layers 38R', 38G', 38B', and 38B' that constitute a pixel, are enclosed with dotted lines.

In the configuration described above, compared to the configuration of the second embodiment, the distance between the cathode electrodes 14" is shortened. Therefore, more of the cathode electrodes 14" may be disposed on the first substrate having the same area, thereby having the advantage of producing a high resolution.

Figure 10:
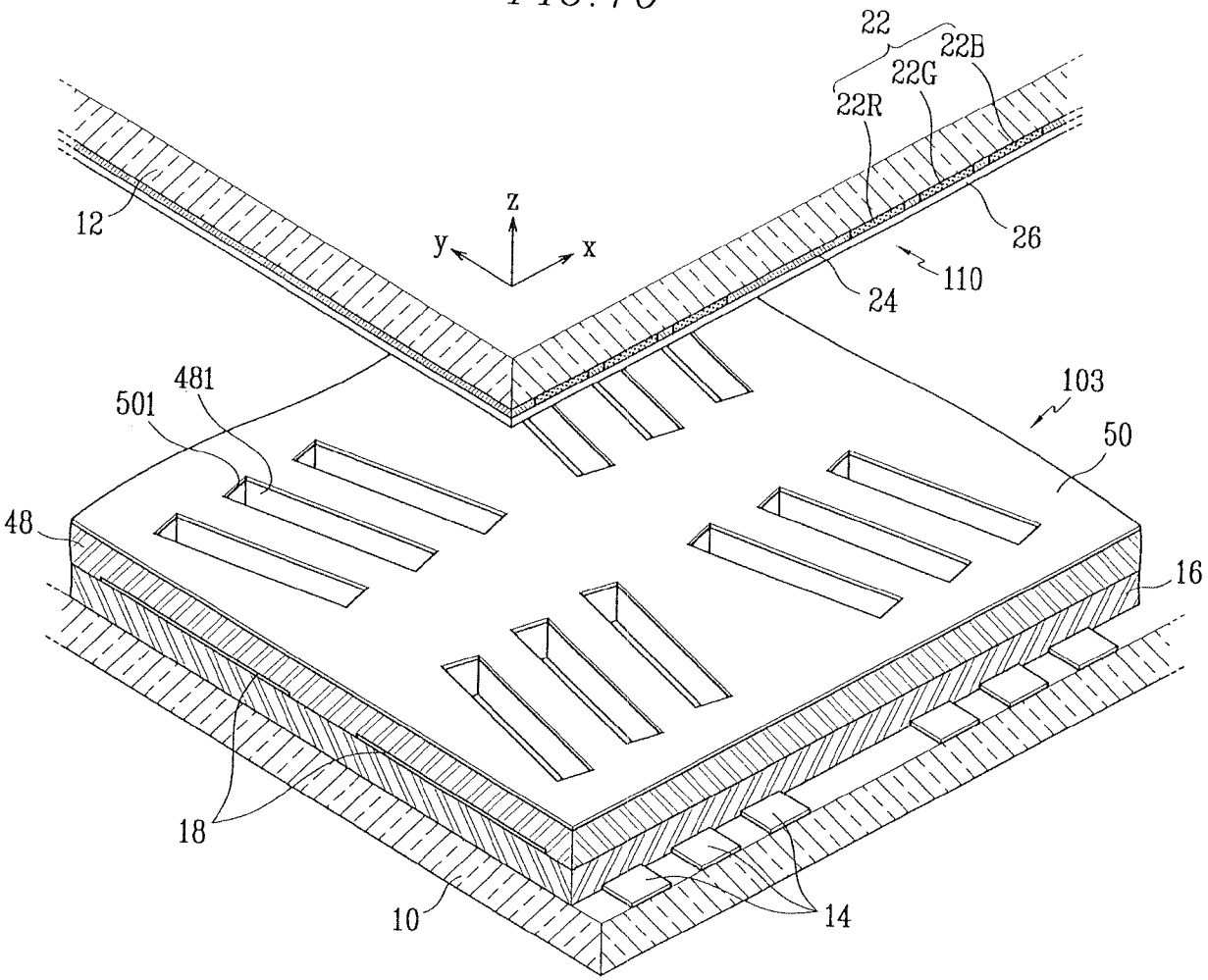
FIG. 10 is a partially exploded perspective view of an electron emission display according to a fourth embodiment of the present invention.

Meanwhile, in the first through third embodiments described above, an additional insulation layer and focusing electrode may be disposed on the gate electrodes. For example, the electron emission display of FIG. 1 can further include an isolation layer 48 and focusing electrode 50 as shown in FIG. 10.

The isolation layer 48 and focusing electrode 50 form openings 481 and 501 so that an electron beam may pass through. The openings 481 and 501 may be formed at the respective intersected regions of the cathode and gate electrodes 14 and 18, or may be formed corresponding to the respective electron emission regions (not shown). In FIG. 10, the former case is shown.

When operating a display device, the focusing electrode 50 receives 0V or a negative direct current voltage of several to ten volts, and emitted electrons are focused to the center of the bundle of electron beams while passing the openings 501 of the focusing electrode 50.

Therefore, when aspects of the present invention are applied to a light emission device, increased luminance is obtained.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission display comprising:

first and second substrates facing each other and having a long-axis and a short-axis;

first electrodes arranged on the first substrate;

second electrodes arranged to intersect the first electrodes and insulated from the first electrodes;

electron emission regions electrically connected to one of the first and second electrodes; and phosphor layers formed on a surface of the second substrate, wherein:

intersected regions of the first and second electrodes are disposed at an acute angle or an obtuse angle to the long-axis direction of the first substrate, three intersected regions constitute a set, each of the three intersected regions extending in the long-axis direction of the first substrate with the same angle to the long-axis direction of the first substrate, the set of intersected regions is disposed at either an acute or obtuse angle to the long-axis direction of the first substrate, and an adjacent set in the long-axis or the short-axis direction of the first substrate is disposed at the other of either an acute or obtuse angle to the long-axis direction of the first substrate, and the adjacent intersected regions are disposed at different angles.

2. The electron emission display of claim 1, wherein one of the intersected regions is disposed at either an acute or obtuse angle to the long-axis direction of the first substrate, and an adjacent intersected region of the intersected region in the long-axis or the short-axis direction of the first substrate is disposed at the other angle to the long-axis direction of the first substrate.

3. The electron emission display of claim 2, wherein the intersected regions comprise:

first and second intersected regions neighboring in the long-axis of the first substrate; and third and fourth intersected regions disposed next to the first and second intersected regions in the short-axis of the first substrate wherein the first and fourth intersected regions are disposed at either an acute or obtuse angle to the long-axis direction of the first substrate, and the second and third intersected regions are disposed at the other angle to the long-axis direction of the first substrate.

4. The electron emission display of claim 3, wherein sets comprising the first through fourth intersected regions are disposed in parallel extending in the long-axis and short-axis direction of the first substrate.

5. The electron emission display of claim 3, wherein sets comprising the first through fourth intersected regions are disposed alternately in a zigzag pattern extending in the long-axis direction of the first substrate.

6. The electron emission display of claim 5, wherein the intersected regions further include:

fifth and sixth intersected regions disposed adjacent to the first and second intersected regions in the long-axis direction of the first substrate; and seventh and eighth intersected regions disposed adjacent to the fifth and sixth intersected regions in the short-axis direction of the first substrate wherein the sixth and seventh intersected regions are disposed with the same angle as that of the first intersected region to the long-axis direction of the first substrate, and the fifth and eighth intersected regions are disposed with the same angle as that of the second intersected region to the long-axis direction of the first substrate.

7. The electron emission display of claim 1, wherein the sum of the angles of the acute and obtuse angles is 180°.

8. The electron emission display of claim 2, wherein the sum of the angles of the acute and obtuse angles is 180°.

9. The electron emission display of claim 1, one of the first and second electrodes further comprising:

a screen region in which one of the first and second electrodes forms an intersected region with the other electrode; and a connection region connected to the screen region wherein the screen and connection regions are disposed with a predetermined angle to each other.

10. The electron emission display of claim 1, wherein the electron emission regions are disposed at the intersected regions in a row extending in the lengthwise direction of the intersected region.

11. The electron emission display of claim 1, wherein the phosphor layers comprising red, green, and blue phosphor layers are disposed opposite the respective intersected regions, and wherein the red, green, and blue phosphor layers are disposed at the intersected regions of the set.

12. The electron emission display of claim 3, wherein the phosphor layers comprise red, green, and blue phosphor layers, wherein the red, green, and blue phosphor layers are disposed respectively opposite a set of three intersected regions, and wherein one of the red, green, and blue phosphor layers is additionally disposed opposite the remaining intersected region of the set.

13. The electron emission display of claim 1, wherein a focusing electrode is disposed on the upper part of the first and second electrodes and maintains electrical isolation between the focusing electrode and the first and second electrodes by an isolation layer disposed underneath of the focusing electrode.

14. The electron emission display of claim 13, wherein openings are formed in the focusing electrode and the isolation layer corresponding to the respective electron emission regions or the intersected regions.

15. The electron emission display of claim 1, further comprising:

an insulation layer disposed between the first electrodes and the second electrodes;

openings in the insulation layer; and openings in the second electrodes;

wherein the electron emission regions are disposed at the intersected regions in a row extending in the lengthwise direction of the intersected region, and each of the electron emission regions are disposed on the first electrodes within the openings of the insulation layer.

16. The electron emission display of claim 15, wherein the electron emission regions have a circular shape.

17. The electron emission display of claim 1, wherein a sealing member is disposed around the perimeters of the first and second substrates forming a sealed inner space, and the inner space is evacuated to a predetermined degree of vacuum.

18. The electron emission display of claim 1, wherein a black layer is formed in the plane of the phosphor layers between each group of red, blue and green phosphor layers.

19. The electron emission display of claim 18, further comprising spacers disposed between the first and second substrates opposite the black layers.

20. The electron emission display of claim 1, further comprising a metal anode layer formed on the surface of the phosphor layers facing the first substrate.

* * * * *